US011205865B2

(12) United States Patent
Hashimoto et al.

(10) Patent No.: US 11,205,865 B2
(45) Date of Patent: Dec. 21, 2021

(54) MULTI-PART WIRE TERMINAL WITH SEALING MEMBER

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tsutomu Hashimoto, Mie (JP); Hiroki Hirai, Mie (JP); Hisashi Sawada, Mie (JP); Kosuke Sone, Mie (JP); Toshikazu Saba, Mie (JP); Takehiro Matsunaga, Mie (JP); Yasuto Takeda, Mie (JP); Yoshitaka Ikeda, Mie (JP); Kazuyoshi Ohara, Mie (JP); Takahiro Maruyama, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/649,132

(22) PCT Filed: Sep. 20, 2018

(86) PCT No.: PCT/JP2018/034884
§ 371 (c)(1),
(2) Date: Mar. 19, 2020

(87) PCT Pub. No.: WO2019/059301
PCT Pub. Date: Mar. 28, 2019

(65) Prior Publication Data

US 2020/0259275 A1 Aug. 13, 2020

(30) Foreign Application Priority Data

Sep. 21, 2017 (JP) ..... JP2017-181592

(51) Int. Cl.
*H01R 4/70* (2006.01)

(52) U.S. Cl.
CPC ..... *H01R 4/70* (2013.01)

(58) Field of Classification Search
CPC ..... H01R 4/70; H01R 4/185
See application file for complete search history.

(56) References Cited

U.S. PATENT DOCUMENTS 7,115,004 B2 * 10/2006 Takayama ..... H01R 4/185 439/852
8,337,227 B2 * 12/2012 Arai ..... H01R 13/5219 439/271

(Continued)

FOREIGN PATENT DOCUMENTS

JP 2005-346940 12/2005
JP 2007-294155 11/2007

(Continued)

OTHER PUBLICATIONS

International Search Report dated Dec. 18, 2018.

*Primary Examiner* — Vanessa Girardi
(74) *Attorney, Agent, or Firm* — Gerald E. Hespos; Michael J. Porco; Matthew T. Hespos

(57) ABSTRACT

A terminal-equipped wire (1) includes a connector terminal (2), a wire (3), a relay conductor (4) and a sealing member (5). The connector terminal (2) is arranged in an insertion hole (71) provided in a connector case (7). The wire (3) is formed by bundling a plurality of conductors (31). The relay conductor (4) is composed of one conductor and electrically connects the connector terminal (2) and the wire (3). The sealing member (5) is mounted on the outer periphery of the relay conductor (4) and arranged in the insertion hole (71) to close a clearance (S1) between the inner periphery of the sealing member (5) and the outer periphery of the relay (Continued)

conductor (4) and a clearance (S2) between the outer periphery of the sealing member (5) and the inner periphery of the insertion hole (71).

4 Claims, 17 Drawing Sheets

(56) References Cited

U.S. PATENT DOCUMENTS

| | | | | |
|---|---|---|---|---|
| 9,281,574 | B2 * | 3/2016 | Kawamura | H01R 4/029 |
| 10,374,328 | B2 * | 8/2019 | Bhagyanathan-Sathlanathan | H01R 13/432 |
| 2005/0266731 | A1 | 12/2005 | Kobayashi et al. | |
| 2011/0045697 | A1 | 2/2011 | Sawamura | |
| 2016/0111809 | A1 * | 4/2016 | Kataoka | H01R 13/5205 439/587 |

FOREIGN PATENT DOCUMENTS

| | | |
|---|---|---|
| JP | 2009-272188 | 11/2009 |
| JP | 2009-277556 | 11/2009 |
| JP | 2014-211954 | 11/2014 |
| JP | 2015-162372 | 9/2015 |

* cited by examiner

MULTI-PART WIRE TERMINAL WITH SEALING MEMBER

BACKGROUND

Field of the Invention

The invention relates to a terminal-equipped wire in which a connector terminal is provided on an end part of a wire.

Related Art

Terminal-equipped wires are used for wiring to a control device in various electronic devices automotive vehicles. The terminal-equipped wire has a connector terminal to be inserted into a connector case, and a wire with bundled conductors is connected to the connector terminal. Some electronic devices are wired using terminal-equipped wires in environments that are exposed to a liquid, such as oil or water. There is a concern that when the liquid contacts an end part of the wire connected to the electronic device, this liquid will penetrate between the conductors of the wire by a capillary phenomenon. Liquid that has penetrated between the conductors from the end part of the wire on the side of the electronic device can penetrate to an opposite end part of the wire by a capillary phenomenon and can intrude into the control device. Accordingly, Japanese Unexamined Patent Publication No. 2009-272188 discloses filling a water sealant between the strands of the core exposed portion connected to the control device, and the core exposed portion filled with the water sealant is covered by a waterproof sheet. The sealant prevents penetration of the liquid to the connector terminal provided on the end part of the wire so that the liquid cannot intrude into the control device.

However, Japanese Unexamined Patent Publication No. 2009-272188 requires an insulation coating to be removed at an intermediate position of the wire to form the core exposed portion. This removal is made while leaving the insulation coating on the end part of the wire, and work efficiency is poor. Further, in Japanese Unexamined Patent Publication No. 2009-272188, an operation of curing the water sealant and covering the core exposed portion filled with the water sealant by the waterproof sheet is necessary after the water sealant is filled between the strands of the core exposed portion. Thus, many labor-hours are required to manufacture the terminal-equipped wire and productivity is poor.

The invention was developed in view of such a problem and aims to provide a terminal-equipped wire capable of preventing liquid penetration to a connector terminal from between conductors of a wire and improving efficiency and productivity during manufacturing.

SUMMARY

One aspect of the invention is directed to a terminal-equipped wire with a connector terminal to be arranged in an insertion hole in a connector case. The terminal equipped wire includes a wire formed by bundling conductors and a relay conductor composed of one conductor. The relay conductor electrically connects the connector terminal and the wire. A sealing member is mounted on an outer periphery of the relay conductor. The sealing member is arranged in the insertion hole to close a clearance between the sealing member and the relay conductor and a clearance between the sealing member and the insertion hole. The connector terminal and the wire formed by bundling the conductors are connected electrically using the relay conductor, and the sealing member mounted on the outer periphery of the relay conductor prevents liquid penetration to the connector terminal from the wire and the relay conductor.

Liquid, such as oil or water, can penetrate between the conductors of the wire from an end part of the wire on an electronic device side in the terminal-equipped wire, and this liquid, can penetrate to the end part of the wire on the connector terminal side by a capillary phenomenon. However, the relay conductor is formed by one conductor. Thus, no clearance is formed in the conductor and a phenomenon that the liquid penetrates between conductors does not occur.

Liquid that has penetrated between the conductors of the wire could reach the relay conductor, and there is a concern that this liquid can flow to the connector terminal along the outer periphery of the relay conductor. However, the sealing member closes the clearance between the inner periphery of the sealing member and the outer periphery of the relay conductor and also the clearance between the outer periphery of the sealing member and the inner periphery of the insertion hole. Thus, the liquid cannot penetrate to the connector terminal. Accordingly, the liquid cannot intrude from the connector terminal and the connector case to a control device or the like.

The connector terminal and the wire can be electrically connected via the relay conductor by various means, such as crimping, welding and soldering. Further, the number of processes in mounting the sealing member on the outer periphery of the relay conductor is small. Thus, work efficiency in electrical connection and mounting is improved and productivity to manufacture the terminal-equipped wire also is improved.

Therefore, the above-described terminal-equipped wire prevents liquid penetration to the connector terminal from between the conductors of the wire, and work efficiency and productivity during manufacturing can be improved.

Note that a harness part used in an automotive vehicle or the like can be formed by using a plurality of terminal-equipped wires and a connector case provided with a plurality of insertion holes. The harness part is formed by bundling the respective terminal-equipped wires inserted into the respective insertion holes of the connector case with each other.

DETAILED DESCRIPTION

Preferred embodiments of the above terminal-equipped wire are described with reference to the drawings.

First Embodiment

Figure 1:
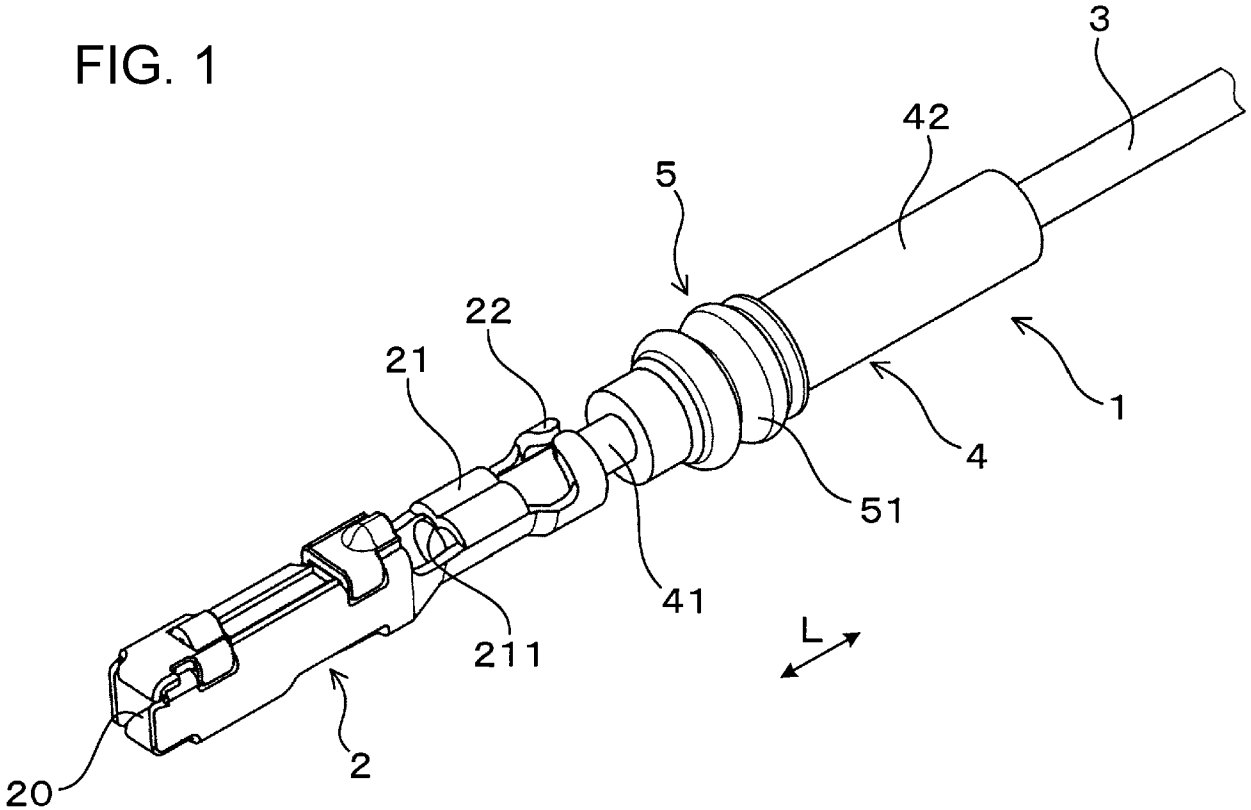
FIG. 1 is a perspective view showing a terminal-equipped wire according to a first embodiment.
Figure 2:
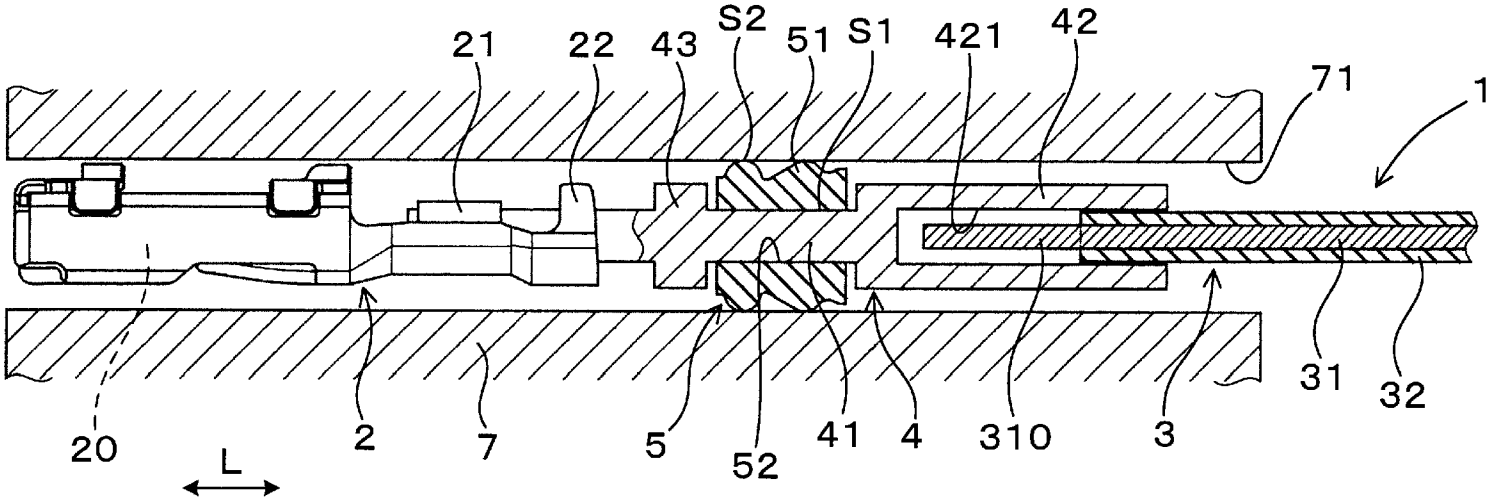
FIG. 2 is a section showing the terminal-equipped wire according to the first embodiment inserted in an insertion of a connector case.
Figure 3:
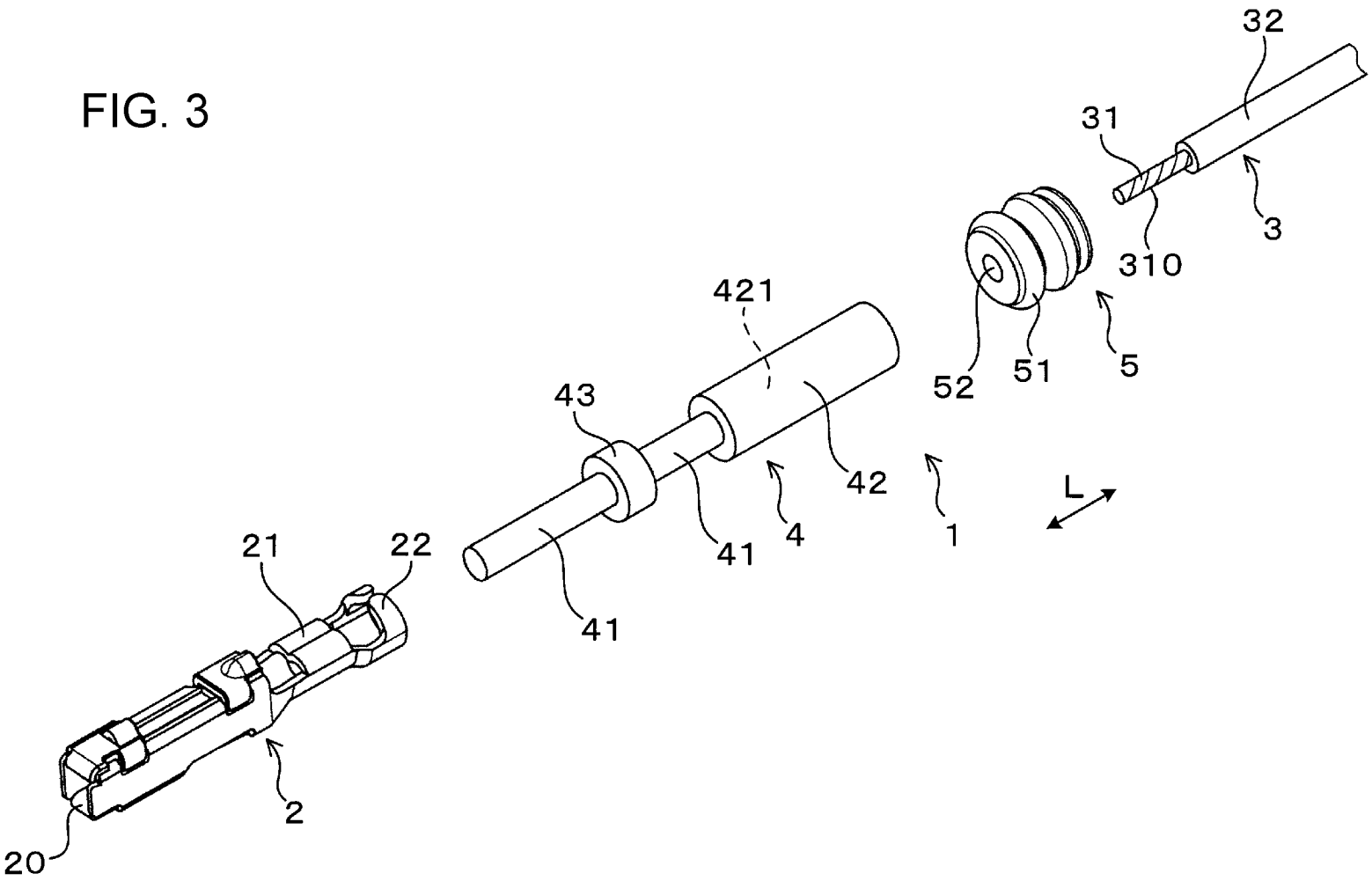
FIG. 3 is a perspective view showing each component of the terminal-equipped wire according to the first embodiment.

A terminal-equipped wire 1 of this embodiment includes a connector terminal 2, a wire 3, a relay conductor 4 and a sealing member 5, as shown in FIGS. 1 to 3. The connector terminal 2 is arranged in an insertion hole 71 provided in a connector case 7. The wire 3 is formed by bundling conductors 31. The relay conductor 4 is composed of one conductor and electrically connects the connector terminal 2 and the wire 3. The sealing member 5 is mounted on the outer periphery of the relay conductor 4 and is arranged in the insertion hole 71 to close a clearance S1 between the inner periphery of the sealing member 5 and the outer periphery of the relay conductor 4, and also a clearance S2 between the outer periphery of the sealing member 5 and the inner periphery of the insertion hole 71.

The terminal-equipped wire 1 of this embodiment is described in detail below.

(Terminal-Equipped Wire)

The terminal-equipped wire 1 is used to wire an electronic device such as an actuator or sensor used in an automotive vehicle, such as a four-wheeled automobile or two-wheeled automobile to a control device for controlling the electronic device. Plural terminal-equipped wires 1 are mounted into the connector case 7. Then, a harness part in which the terminal-equipped wires 1 and the connector case 7 are integrated is formed.

The terminal-equipped wire 1 of this embodiment is used to connect an automatic transmission, serving as the electronic device installed in the automotive vehicle, to an electronic control unit (ECU), serving as the control device. Oil (working oil) for an automatic shift control operation is used in the automatic transmission. An end part of the wire 3 on the electronic device side in the terminal-equipped wire 1 is connected to a valve body of the automatic transmission. This end part of the wire 3 on the electronic device side is immersed in the oil. The valve body is for controlling an operation in a hydraulic circuit of the automatic transmission and includes solenoid valves as actuators and spool valves configured to slide by turning on and off energization to the solenoid valves.

(Connector Case 7)

The connector case 7 into which the terminal-equipped wires 1 are mounted is arranged on the automatic transmission or the like and mounted on a mating connector provided on the electronic control unit. The connector case 7 is formed with the insertion holes 71 arranged side by side, and the connector terminals 2 are inserted and held in the insertion holes 71. The mating connector is provided with conductor pins to be connected to the respective connector terminals 2.

Note that each connector terminal 2 arranged in the connector case 7 may be connected to the electronic control unit via the mating connector and a wire. Further, the connector case 7 having the terminal-equipped wires 1 mounted therein and the mating connector can also be used as relay connectors for electrically connecting the valve body and the electronic control unit.

(Connector Terminal 2)

The connector terminal 2 is made of a conductive metal plate that is bent into a specified shape to define a female terminal with an inlet hole 20 into which the conductor pin of a mating connector is inserted. However, the connector terminal 2 may be formed as a male terminal, such as a conductor pin, and the mating connector may have a female terminal into which the male terminal is inserted.

As shown in FIG. 1, the connector terminal 2 is formed with a first terminal connecting portion 21 connected to the outer periphery of a tip part of the relay conductor 4 and a second terminal connecting portion 22 adjacent to the first terminal connecting portion 21 and connected to the outer periphery of the relay conductor 4. The first and second terminal connecting portions 21, 22 of this embodiment are formed as crimping portions that embrace the relay conductor 4 in a circumferential direction from both sides. A biting portion 211 is formed on an end part of the first terminal connecting portion 21 and is configured to bite into the outer periphery of the tip part of the relay conductor 4. Although, the connector terminal 2 of this embodiment is formed as a crimping terminal to be crimped to the relay conductor 4, the connector terminal 2 may be joined to the relay conductor 4 by welding, soldering or the like.

(Wire 3)

As shown in FIGS. 2 and 3, the wire 3 is a stranded wire with bundled conductors 31. An insulation coating layer 32 made of insulating rubber, resin or the like is provided on the entire outer peripheries of the conductors 31. The insulation coating layer 32 is removed on an end part of the wire 3 to be connected to the relay conductor 4, and a conductor 310 in which the outer peripheries of the conductors 31 are exposed is formed on this end part. Note that the exposure of the conductors 31 means that the conductors 31 constitute an outermost peripheral part of the wire 3 when the wire 3 is viewed as a single component.

FIG. 2 shows a state before a conductor connecting portion 42 of the relay conductor 4 is connected to the conductor 310 of the wire 3. The conductor connecting portion 42 subsequently is crimped to the conductor 310 so that the conductor 310 and the conductor connecting portion 42 are in contact with each other.

(Relay Conductor 4)

As shown in FIGS. 2 and 3, the relay conductor 4 is made of a conductive metal material. The relay conductor 4 includes a mounting shaft 41 on which the connector terminal 2 and the sealing member 5 are mounted and the conductor connecting portion 42 connected to the end part of the wire 3 on the side of the relay conductor 4. Since the relay conductor 4 includes the conductor connecting portion 42, the relay conductor 4 and the wire 3 easily can be connected without using another terminal member or the like. The conductor connecting portion 42 of this embodiment is formed as a crimping portion.

The relay conductor 4 is formed as a shaft having a circular cross-sectional shape. A flange 43 projects out on the outer periphery of the mounting shaft 41 to hold the sealing member 5 between the conductor connecting portion 42 and the flange 43. The conductor connecting portion 42 is in the form of a closed hollow cylindrical barrel with a bottomed arrangement hole 421 along an axial direction of the relay conductor 4 to arrange the end part of the wire 3. Since the conductor connecting portion 42 includes the bottomed arrangement hole 421, a liquid penetrating between the conductors 31 of the wire 3 easily can be pooled in the arrangement hole 421 and made less likely to penetrate to the outer periphery of the relay conductor 4.

The conductor connecting portion 42 has an outer diameter larger than that of the mounting shaft 41. The end part of the wire 3 is inserted into the arrangement hole 421 and the conductor connecting portion 42 is deformed to reduce the outer diameter, thereby connecting the conductor connecting portion 42 to the outer peripheries of the conductor 310 and the insulation coating layer 32 on the end part of the wire 3. The sealing member 5 is mounted between the flange 43 and the conductor connecting portion 42 on the outer periphery of the mounting shaft 41.

A minimum cross-sectional area of the relay conductor 4 is larger than a cross-sectional area of the conductor 310 (plurality of conductors 31) in the wire 3. In other words, cross-sectional areas of the mounting shaft 41 and the conductor connecting portion 42 of the relay conductor 4 are larger than that of the conductor 310 in the wire 3. Here, the cross-sectional area is an area of a cross-section perpendicular to a longitudinal direction (axial direction) L of the relay conductor 4 and the wire 3. Since the relay conductor 4 is formed of one conductor, similar to a single-core wire, the liquid does not penetrate into the inside of the relay conductor 4. The longitudinal direction L means an extending direction of the relay conductor 4.

(Sealing Member 5)

As shown in FIGS. 2 and 3, the sealing member 5 is made of a resiliently deformable material such as rubber or resin. A sealing portion 51 to be brought into contact with the insertion hole 71 of the connector case 7 over the entire circumference is provided on the outer periphery of the sealing member 5. A center hole 52 into which the mounting shaft 41 of the relay conductor 4 is inserted is formed in a central part of the sealing member 5. An outer diameter of the sealing portion 51 of the sealing member 5 is largest in the entire terminal-equipped wire 1. A maximum width of the connector terminal 2 in a direction perpendicular to the longitudinal direction (axial direction) L is smaller than the outer diameter of the sealing portion 51.

(Manufacturing Method)

The terminal-equipped wire 1 can be manufactured (assembled) as follows.

First, the sealing member 5 is mounted on the outer periphery of the mounting shaft 41 of the relay conductor 4. At this time, the clearance S1 between the inner periphery of the sealing member 5 and the outer periphery of the relay conductor 4 is closed. Further, when being mounted, the sealing member 5 is deformed resiliently, enlarged in diameter and mounted at a position between the flange 43 and the conductor connecting portion 42 on the mounting shaft 41 from a tip part of the mounting shaft 41. Subsequently, the tip part of the mounting shaft 41 of the relay conductor 4 is inserted into the first and second terminal connecting portions 21, 22 of the connector terminal 2, and the respective terminal connecting portions 21, 22 are deformed using a tool or the like and crimped to the outer periphery of the tip part of the mounting shaft 41.

Further, the insulation coating layer 32 on the end part of the wire 3 on the side of the connector terminal 2 is removed to expose the conductors 31 on this end part as the conductor portion 310. Then, the end part of the wire 3 on the side of the relay conductor 4 in which the conductor 310 is exposed is inserted into the arrangement hole 421 of the conductor connecting portion 42 of the relay conductor 4 and the conductor connecting portion 42 is crimped to the outer periphery of the end part of the wire 3 on the side of the relay conductor 4 by being deformed using a tool or the like. In this way, the terminal-equipped wire 1 is manufactured in which the connector terminal 2, the relay conductor 4 and the sealing member 5 are provided on the end part of the wire 3.

Thereafter, the end part of each terminal-equipped wire 1 having the connector terminal 2, the relay conductor 4 and the sealing member 5 provided thereon is inserted into the insertion hole 71 of the connector case 7. At this time, the clearance S2 between the outer periphery of the sealing member 5 and the inner periphery of the insertion hole 71 is closed. Further, the sealing member 5 is compressed by the insertion hole 71 so that the inner periphery of the sealing member 5 and the outer periphery of the relay conductor 4 are held in closer contact with each other.

Note that the assembling of the terminal-equipped wire 1 and the mounting of the terminal-equipped wire 1 into the connector case 7 are performed by a worker or a control machine such as a robot.

(Functions and Effects)

Next, functions and effects of the terminal-equipped wire 1 of this embodiment are described.

In the terminal-equipped wire 1 of this embodiment, the connector terminal 2 and the wire 3 are connected electrically using the relay conductor 4, and the sealing member 5 mounted on the outer periphery of the relay conductor 4 prevents liquid penetration from the wire 3 and the relay conductor 4 to the connector terminal 2.

The end of the wire 3 on the electronic device side of the terminal-equipped wire 1 is connected to the actuator in the valve body, and this end is immersed in oil in the valve body. Further, minute clearances are formed between the conductors 31 in the wire 3, and the oil enters these minute clearances inside the wire 3 from the end part of the wire 3 on the electronic device side. The oil penetrates toward the relay conductor 4 (toward the control device) between the conductors inside the wire 3 by a capillary phenomenon and reaches the arrangement hole 421 of the conductor connecting portion 42 of the relay conductor 4 from the end part of the wire 3 on the side of the relay conductor 4.

The relay conductor 4 is formed of one conductor, and no clearance is formed therein. Thus, the oil that reaches the arrangement hole 421 cannot penetrate into the relay conductor 4. However, the oil that reaches the arrangement hole 421 penetrates to the outer periphery of the relay conductor 4 from the arrangement hole 421 and there is a concern that this oil may penetrate to the connector terminal 2 along the outer periphery of the relay conductor 4. However, as shown in FIG. 2, the clearance S1 between the inner periphery of the sealing member 5 and the outer periphery of the relay conductor 4 and the clearance S2 between the outer periphery of the sealing member 5 and the inner periphery of the insertion hole 71 are closed by the sealing member 5. As a result, the oil cannot penetrate either to an inner peripheral side of the sealing member 5 or to an outer peripheral side of the sealing member 5. Thus, the oil cannot penetrate to the connector terminal 2. In this way, the intrusion of the liquid into the electronic control unit from the connector terminal 2 and the connector case 7 is prevented.

The connector terminal 2 and the wire 3 can be connected electrically via the relay conductor 4 by crimping the terminal connecting portions 21, 22 of the connector terminal 2 and crimping the conductor connecting portion 42 of the relay conductor 4. Further, the sealing member 5 can be mounted on the outer periphery of the mounting shaft 41 of the relay conductor 4 by being resiliently deformed, and easily can be mounted on the outer periphery of the mounting shaft 41. The sealing member 5 can be mounted by one process and the number of processes is small. Thus, work efficiency in electrical connection and mounting is improved, and productivity to manufacture terminal-equipped wire 1 also is improved.

Therefore, according to the terminal-equipped wire 1 of this embodiment, liquid penetration from between the conductors 31 of the wire 3 to the connector terminal 2 can be prevented and work efficiency and productivity during manufacturing can be improved.

The electronic device using the terminal-equipped wire 1 can be any one of various devices using a liquid such as oil or water instead of the automatic transmission. The liquid penetrating between the conductors 31 of the wire 3 in the terminal-equipped wire 1 may be any one of various liquids such as coolant (cooling liquid) instead of oil.

Further, if a liquid such as oil or water is splashed on the connector case 7 or the terminal-equipped wire 1 from outside, the sealing member 5 can also prevent this liquid from penetrating to the connector terminal 2. In this case, the intrusion of the liquid into the connector terminal 2 is hindered on both the inner periphery and outer periphery of the sealing member 5.

Further, a liquid such as oil is thought not only to penetrate between the conductors 31, but also penetrate between the conductors 31 and the insulation coating layer 32. Liquid penetrating between the conductors 31 and the insulation coating layer 32 is prevented from penetrating to the connector terminal 2 by the configuration of the terminal-equipped wire 1 using the relay conductor 4 and the sealing member 5.

Second Embodiment

A terminal-equipped wire 1 having a structure for electrically connecting a connector terminal 2 and a wire 3 different from that of the first embodiment is shown in this embodiment.

Figure 4:
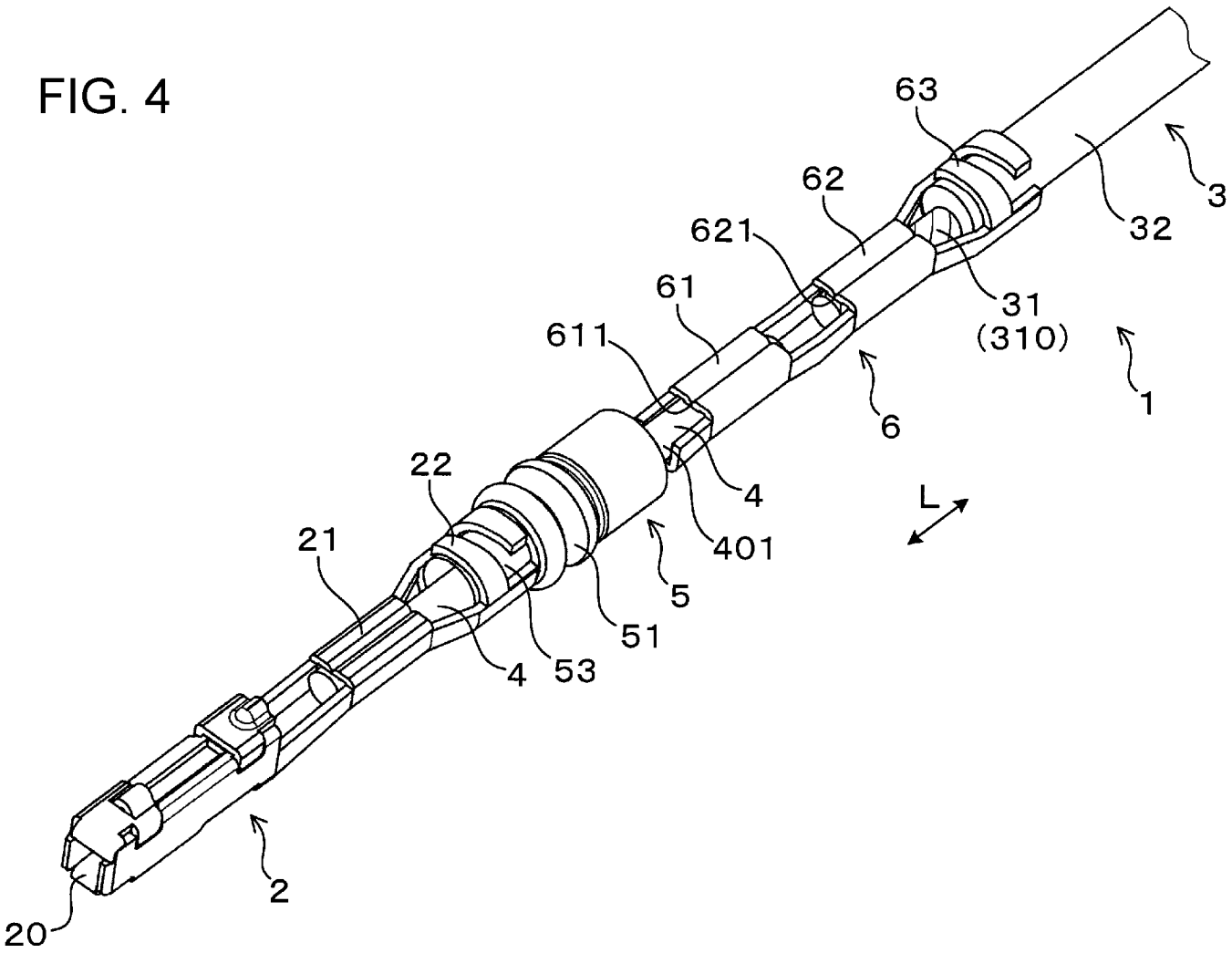
FIG. 4 is a perspective view showing a terminal-equipped wire according to a second embodiment.
Figure 5:
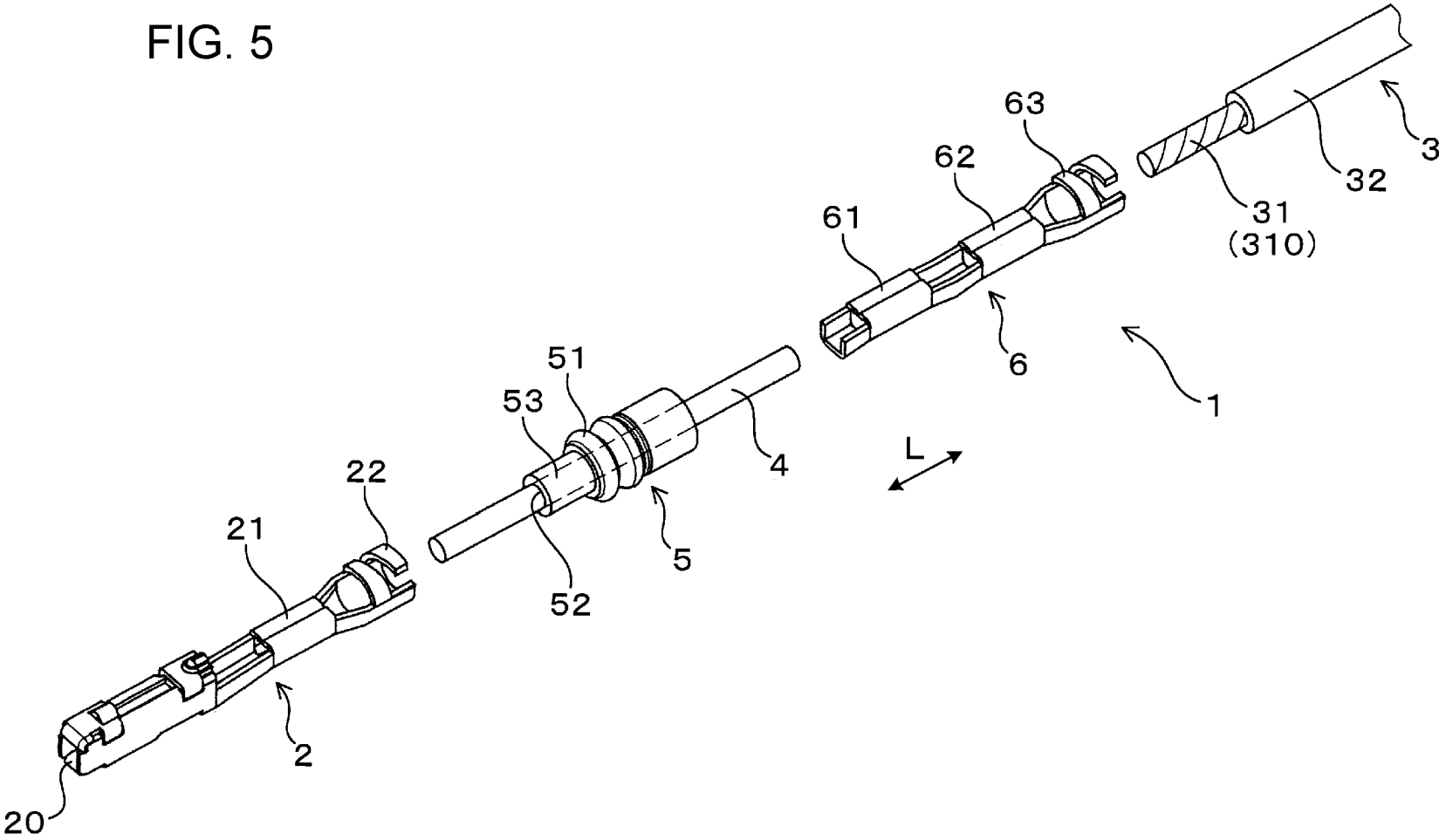
FIG. 5 is a perspective view showing each component of the terminal-equipped wire according to the second embodiment.

As shown in FIGS. 4 and 5, a relay conductor 4 of this embodiment is formed into a shaft shape. The relay conductor 4 is formed by a solid round bar having a substantially constant cross-section along an axial direction thereof. Further, the terminal-equipped wire 1 of this embodiment includes a connection terminal 6 for connecting (coupling) the relay conductor 4 and the wire 3.

The connection terminal 6 includes a first connecting portion 61 to be connected to the relay conductor 4 and a second connecting portion 62 to be connected to a conductor 310 on an end part of the wire 3. The first and second connecting portions 61, 62 of this embodiment are formed as crimping portions. The connection terminal 6 electrically connects conductors 31 of the wire 3 and the relay conductor 4. The connection terminal 6 is made of a conductive metal that is bent into a specified shape.

A third connecting portion 63 to be connected to an insulation coating layer 32 of the wire 3 is formed at a position closer to the wire 3 than the second connecting portion 62 and is formed as a crimping portion. A biting portion 611 configured to bite into the outer periphery of the relay conductor 4 is formed on an end part of the first connecting portion 61, and a biting portion 621 configured to bite into the outer periphery of the conductor 310 is formed on an end part of the second connecting portion 62. The third connecting portion 63 is formed to embrace the insulation coating layer 32 of the wire 3 in a circumferential direction from both sides.

As shown in FIGS. 4 and 5, the sealing member 5 of this embodiment includes a first connecting outer peripheral portion 53 to be connected to the second terminal connecting portion 22 provided on the connector terminal 2 and also a sealing portion 51 for closing an insertion hole 71 of a connector case 7. The first connecting outer peripheral portion 53 is provided on one end part of the sealing member 5 and has an outer diameter smaller than that of the sealing portion 51 of the sealing member 5. The first connecting outer peripheral portion 53 of this embodiment is a crimping outer peripheral portion.

In manufacturing the terminal-equipped wire 1 of this embodiment, the sealing member 5 is mounted on the outer periphery of the relay conductor 4. Subsequently, one end part of the relay conductor 4 is arranged in the first terminal connecting portion 21 of the connector terminal 2, and the first connecting outer peripheral portion 53 of the sealing member 5 is arranged in the second terminal connecting portion 22 of the connector terminal 2. Then, the first terminal connecting portion 21 is crimped to the one end part of the relay conductor 4, and the second terminal connecting portion 22 is crimped to the first connecting outer peripheral portion 53.

Further, the other end part of the relay conductor 4 is arranged in the first connecting portion 61 of the connection terminal 6, and the first connecting portion 61 is crimped to the other end part of the relay conductor 4. Subsequently, the conductor 310 on the end part of the wire 3 is arranged in the second connecting portion 62 of the connection terminal 6, and the insulation coating layer 32 on the end part of the wire 3 is arranged in the third connecting portion 63 of the connection terminal 6. Then, the second connecting portion 62 is crimped to the conductor 310, and the third connecting portion 63 is crimped to the insulation coating layer 32. In this way, the terminal-equipped wire 1 is manufactured in which the connector terminal 2, the relay conductor 4, the sealing member 5 and the connection terminal 6 are provided on the end part of the wire 3.

In this embodiment, the relay conductor 4 can be formed by a round bar having a simple shape by using the connection terminal 6. Further, the axial position of the sealing member 5 on the relay conductor 4 can be fixed by crimping the second terminal connecting portion 22 of the connector terminal 2 to the first connecting outer peripheral portion 53 of the sealing member 5.

The other configuration, functions, effects and the like of the terminal-equipped wire 1 of this embodiment are the same as in the first embodiment. Further, also in this embodiment, constituent elements denoted by the same reference signs as those of the first embodiment are the same as those of the first embodiment.

Third Embodiment

A terminal-equipped wire 1 different from that of the second embodiment in the structures of a sealing member 5 and a connection terminal 6 is shown in this embodiment.

Figure 6:
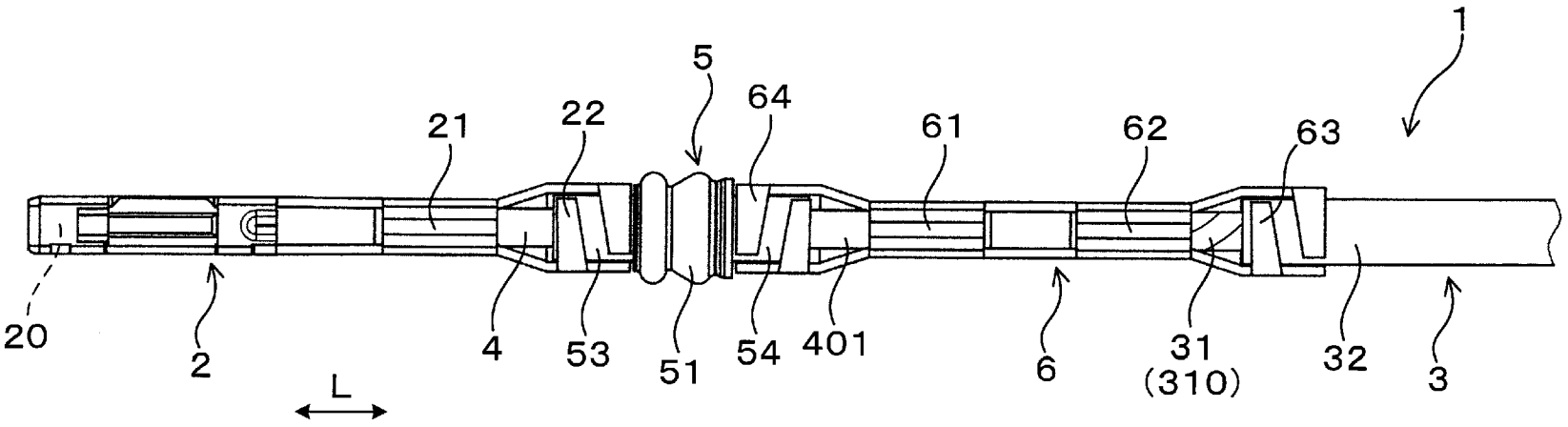
FIG. 6 is a plan view showing a terminal-equipped wire according to a third embodiment.

As shown in FIG. 6, the sealing member 5 includes a second connecting outer peripheral portion 54 to be connected to a fourth connecting portion 64 provided on the connection terminal 6 in addition to a first connecting outer peripheral portion 53. The first connecting outer peripheral portion 53 is formed on an end part of the sealing member 5 on the side of a connector terminal 2, and the second connecting outer peripheral portion 54 is formed on an end part of the sealing member 5 on the side of the connection terminal 6.

The connection terminal 6 of this embodiment includes the fourth connecting portion 64 to be connected to the second connecting outer peripheral portion 54 of the sealing member 5 at a position closer to the connector terminal 2 than a first connecting portion 61. The fourth connecting portion 64 is a crimping portion that is formed to embrace the second connecting outer peripheral portion 54 in a circumferential direction from both sides.

The terminal-equipped wire 1 of this embodiment is basically manufactured as in the case of the second embodiment. In this embodiment, the second connecting outer peripheral portion 54 is arranged in the fourth connecting portion 64 of the connection terminal 6 in arranging a relay conductor 4 in the first connecting portion 61 of the connection terminal 6. Then, the first connecting portion 61 is crimped to the relay conductor 4, and the fourth connecting portion 64 is crimped to the second connecting outer peripheral portion 54. The remainder of the terminal-equipped wire 1 is manufactured as in the case of the second embodiment.

In this embodiment, the fourth connecting portion 64 of the connection terminal 6 is connected to the second connecting outer peripheral portion 54 of the sealing member 5, as shown in FIG. 6, so that end parts of the relay conductor 4 and the sealing member 5 on the side of the connection terminal 6 have a stronger structure. Thus, stress generated when vibration or the like is applied to the terminal-equipped wire 1 is less likely to be concentrated on a part 401 of the relay conductor 4 near the end part of the sealing member 5 on the side of the connection terminal 6. In this way, the relay conductor 4 is protected from damage.

Further, in this embodiment, the axial position of the sealing member 5 with respect to the relay conductor 4 can be fixed more firmly by crimping the fourth connecting portion 64 of the connection terminal 6 to the second connecting outer peripheral portion 54 of the sealing member 5.

Although not shown, the sealing member 5 may include the second connecting outer peripheral portion 54 without including the first connecting outer peripheral portion 53. Also in this case, the axial position of the sealing member 5 with respect to the relay conductor 4 can be fixed.

The other configurations, functions, effects and the like of the terminal-equipped wire 1 of this embodiment are the same as in the second embodiment. Further, constituent elements denoted by the same reference signs as those of the second embodiment are the same as those of the second embodiment.

Fourth Embodiment

A terminal-equipped wire 1 different from that of the second embodiment in the structure of a connection terminal 6 is shown in this embodiment.

Figure 7:
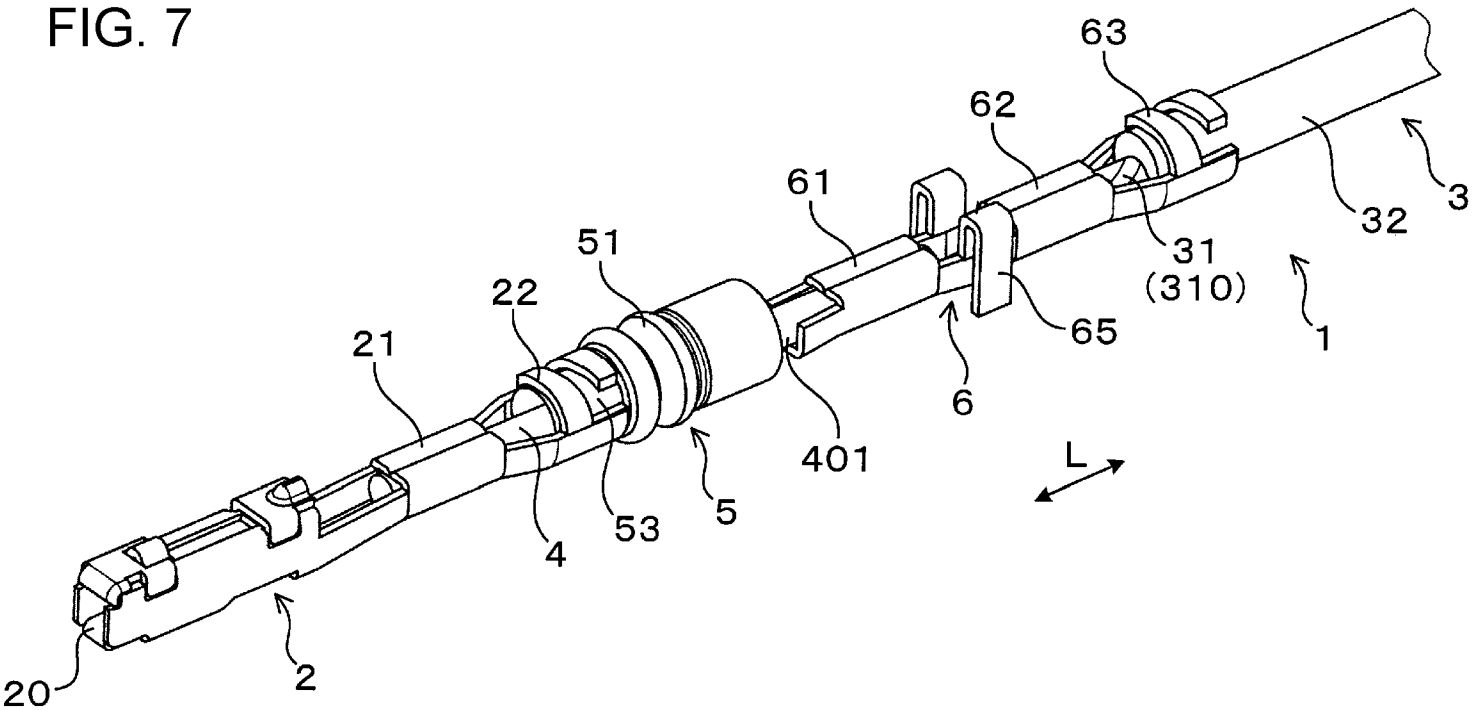
FIG. 7 is a perspective view showing a terminal-equipped wire according to a fourth embodiment.

As shown in FIG. 7, the connection terminal 6 of this embodiment is formed with projections 65 configured to contact an insertion hole 71 of a connector case 7. The projections 65 can contact the insertion hole 71 and support the connection terminal 6 in the insertion hole 71. The projections 65 project outward of the connection terminal 6 from a position between first and second connecting portions 61, 62 in the connection terminal 6. Outward means a direction perpendicular to a longitudinal direction L of the connection terminal 6, and hence in a radial direction of the insertion hole 71. Further, the projections 65 are formed by parts of a plate forming the connection terminal 6 extending toward both sides. Note that the longitudinal direction L means a direction in which a relay conductor 4 and the connection terminal 6 extend.

Slight clearances may be present between the projections 65 and the insertion hole 71 when a terminal part of the terminal-equipped wire 1 is inserted into the insertion hole 71. Also in this case, the projections 65 come into contact with the insertion hole 71 due to vibration or the like when the terminal-equipped wire 1 is used.

The terminal-equipped wire 1 of this embodiment is supported in the insertion hole 71 of the connector case 7 by a sealing portion 51 of a sealing member 5 and the projections 65 of the connection terminal 6. In this way, the terminal-equipped wire 1 is less likely to vibrate with respect to the connector case 7. Thus, a part 401 of the relay conductor 4 near an end part of the sealing member 5 on the side of the connection terminal 6 is less likely to be damaged.

The projections 65 can be formed into various shapes to contact the inside of the insertion hole 71. The terminal part of the terminal-equipped wire 1 is longer when the connection terminal 6 is used than when the connection terminal 6 is not used. Thus, it is effective to provide the projections 65 to make the terminal part of the terminal-equipped wire 1 less likely to be vibrated by vibration transmitted to the terminal-equipped wire 1.

The projections 65 can be at a position distant from the sealing member 5 in the longitudinal direction L, e.g. in an intermediate part of the connection terminal 6 in the longitudinal direction L or in a base end part of the connection terminal 6 in the longitudinal direction L. The base end part means a part close to the wire 3 in the longitudinal direction L of the connection terminal 6.

Further, the projections 65 can be formed into a resiliently deformable shape. In this case, when the projections 65 come into contact with the insertion hole 71, a spring force due to resilient deformation can be generated from the projections 65 to the insertion hole 71. The projections 65 can be deformed resiliently when the terminal part of the terminal-equipped wire 1 is inserted into the insertion hole 71. By causing the projections 65 to generate the spring force while maintaining easy insertion of the terminal part of the terminal-equipped wire 1 into the insertion hole 71, the projections 65 can more reliably contact the insertion hole 71.

Figure 8:
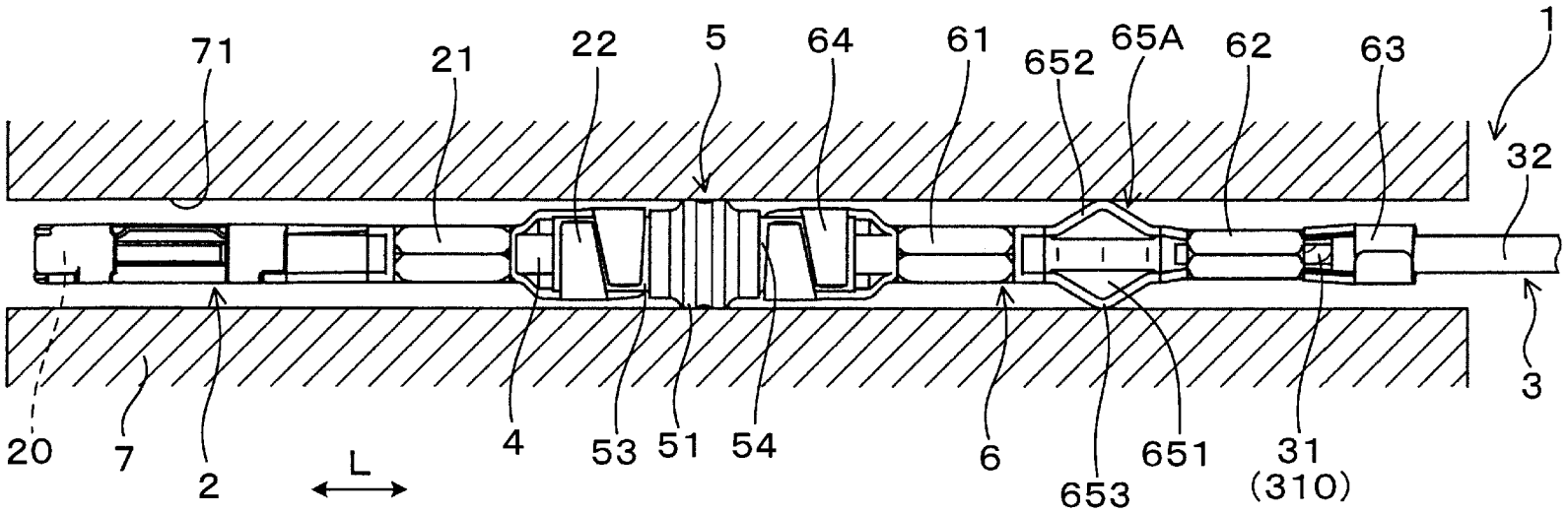
FIG. 8 is a plan view showing another terminal-equipped wire according to the fourth embodiment inserted in an insertion hole of a connector case.
Figure 9:
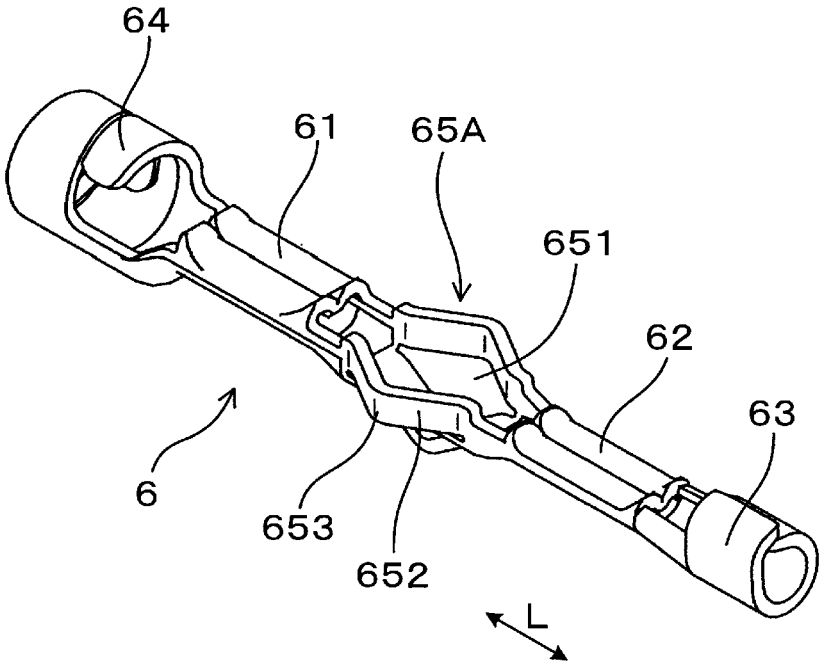
FIG. 9 is a perspective view showing the other terminal-equipped wire according to the fourth embodiment.

As shown in FIGS. 8 and 9, a projection 65A can be composed of strip-like portions 652 formed on both sides of a slit(s) 651 by one or more slits (cutouts) 651 along the longitudinal direction L in an intermediate part of the connection terminal 6 in the longitudinal direction L. The strip-like portion 652 defines a fixed beam having both ends in the longitudinal direction L supported on a body of the connection terminal 6. In this case, the intermediate part of the strip-like portion 652 in the longitudinal direction L is caused to bulge out in a direction perpendicular to the longitudinal direction L and forms a projecting top 653. Thus, the strip-like portion 652 can be made resiliently deformable. The projecting top 653 can be formed by bending the strip-like portion 652. Further, the projecting top 653 of each strip-like portion 652 projects most outward in the direction perpendicular to the longitudinal direction L and contacts the insertion hole 71.

The strip-like portions 652 shown in FIGS. 8 and 9 are formed at three positions, i.e. on both sides in a width direction perpendicular to the longitudinal direction L and one side in a height direction perpendicular to the width direction. The three strip-like portions 652 are made resiliently deformable by forming the projecting tops 653. Alternatively, the resiliently deformable strip-like portions 652 can be formed, for example, only on two opposite sides in the width direction perpendicular to the longitudinal direction L or only on one side in the height direction.

Figure 10:
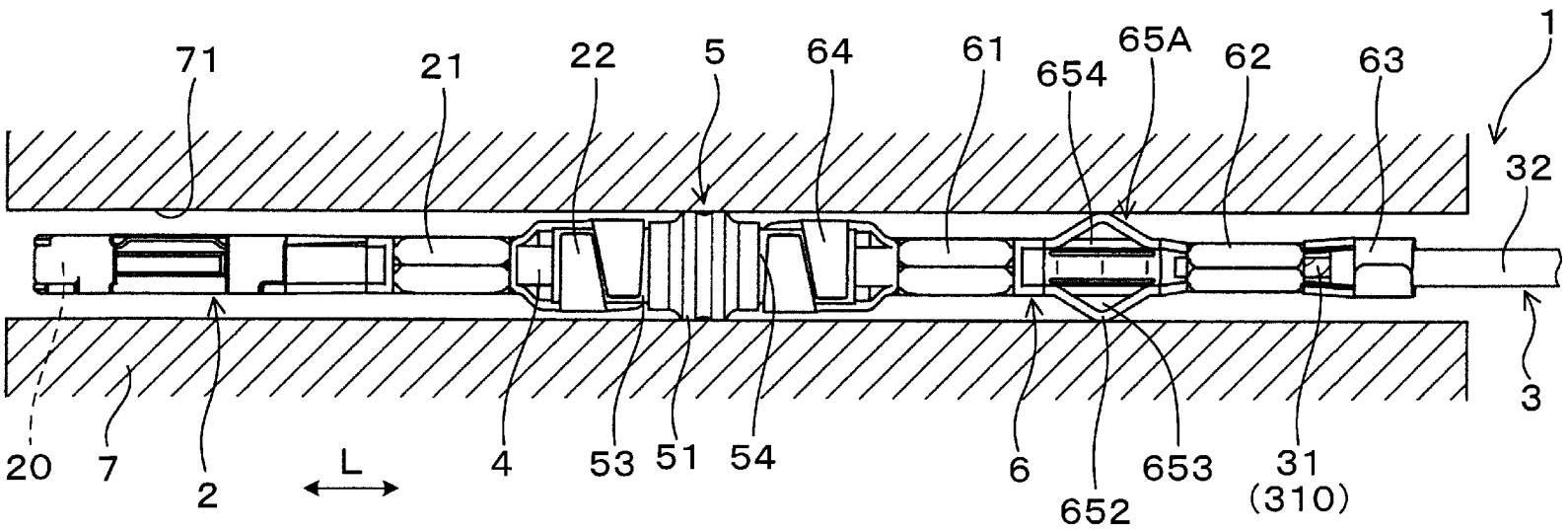
FIG. 10 is a plan view showing another terminal-equipped wire according to the fourth embodiment inserted in the insertion hole of the connector case.
Figure 11:
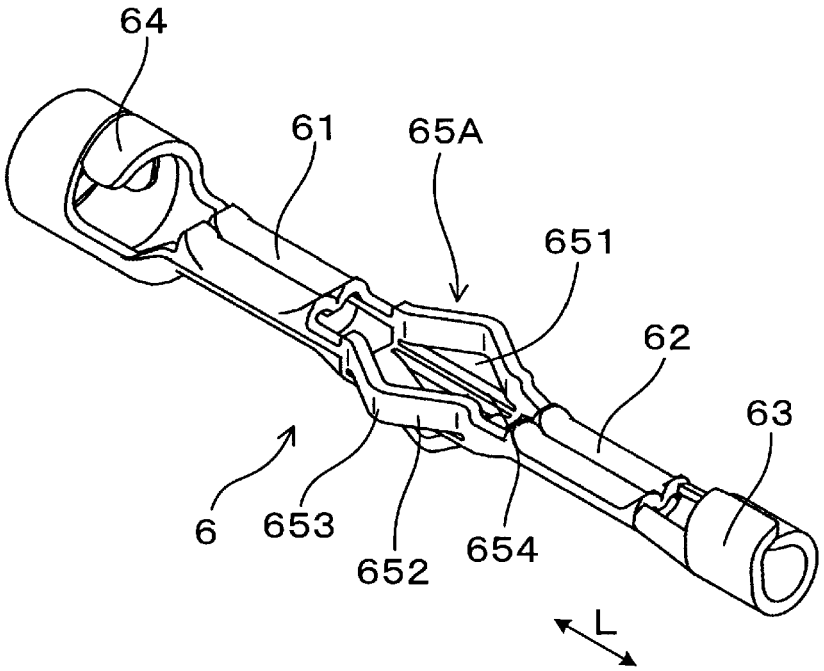
FIG. 11 is a perspective view showing the other terminal-equipped wire according to the fourth embodiment.

Further, as shown in FIGS. 10 and 11, a reinforcing strip-like portion 654 not constituting the projection 65A can be formed between the strip-like portions 652. The reinforcing strip-like portion 654 can be parallel to the longitudinal direction L and can be formed between the strip-like portions 652 in a direction about a center axis along the longitudinal direction L of the connection terminal 6. Further, any one of the strip-like portions 652 may be the reinforcing strip-like portion 654 not constituting the projection 65A.

By forming the slit 651 in the connection terminal 6, an electrical resistance value of the connection terminal 6 may increase and the strength of the connection terminal 6 may be reduced. Accordingly, by forming the connection terminal 6 with the reinforcing strip-like portion 654 together with the strip-like portions 652, the electrical resistance value of the connection terminal 6 can be maintained low and the strength of the connection terminal 6 can be maintained as high as possible.

Figure 12:
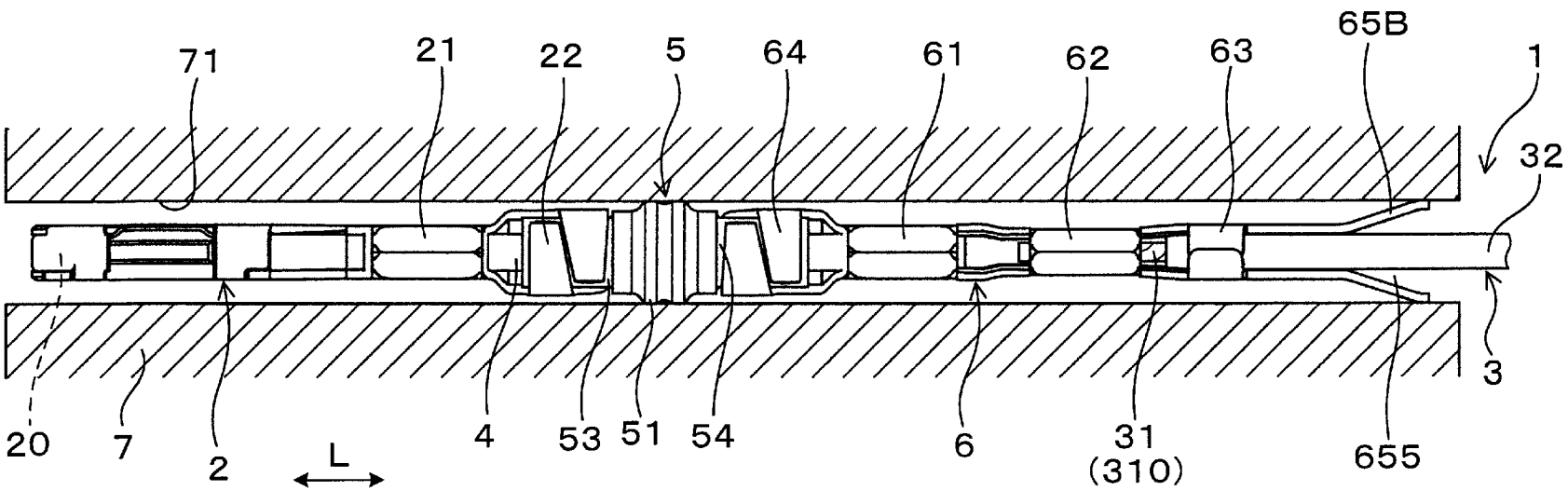
FIG. 12 is a plan view showing another terminal-equipped wire according to the fourth embodiment inserted in the insertion hole of the connector case.
Figure 13:
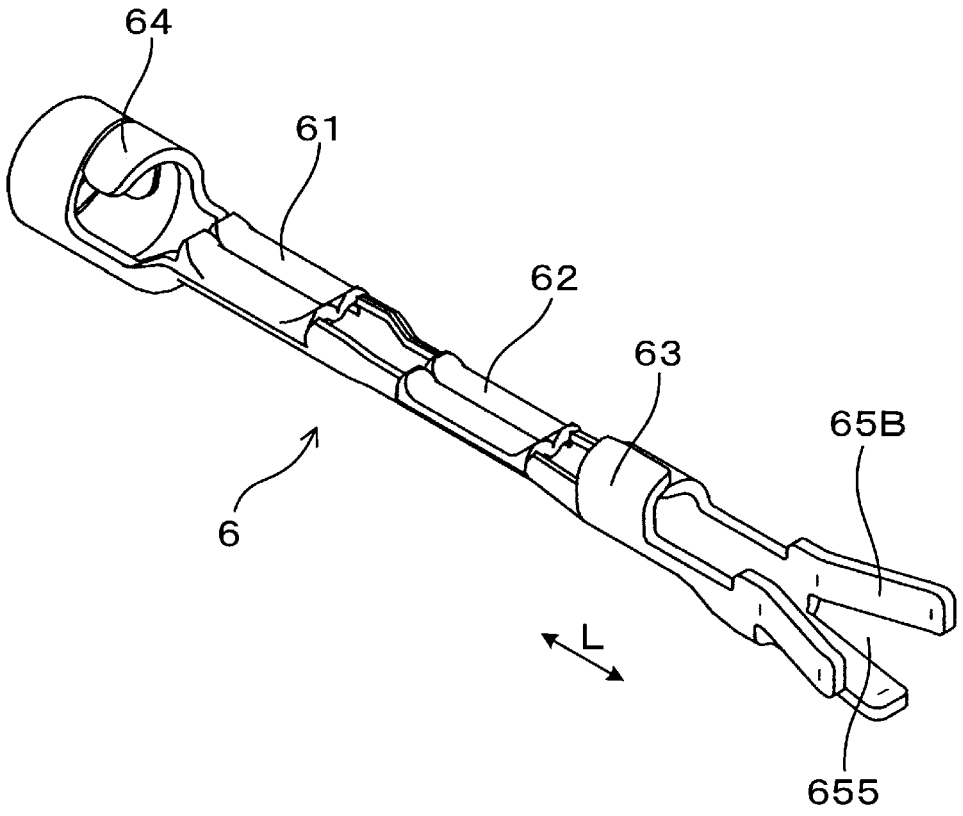
FIG. 13 is a perspective view showing the other terminal-equipped wire according to the fourth embodiment.

Further, as shown in FIGS. 12 and 13, projections 65B can be formed by one or more cutouts 655 formed in a base end of the connection terminal 6 in the longitudinal direction L in a base end part of the connection terminal 6 in the longitudinal direction L. The projections 65B can be formed by being bent in a direction perpendicular to the longitudinal direction L and can be deformed resiliently by having a cantilever shape with one end supported on the body of the connection terminal 6.

In this case, when tip parts of the projections 65B contact the insertion hole 71 in inserting the terminal part of the terminal-equipped wire 1 into the insertion hole 71, the tip parts of the projections 65B can be deformed resiliently and can cause a spring force to act on the insertion hole 71. Further, one, two or more projections 65B can be formed. A case where three projections 65B are formed is shown in FIGS. 12 and 13.

Figure 14:
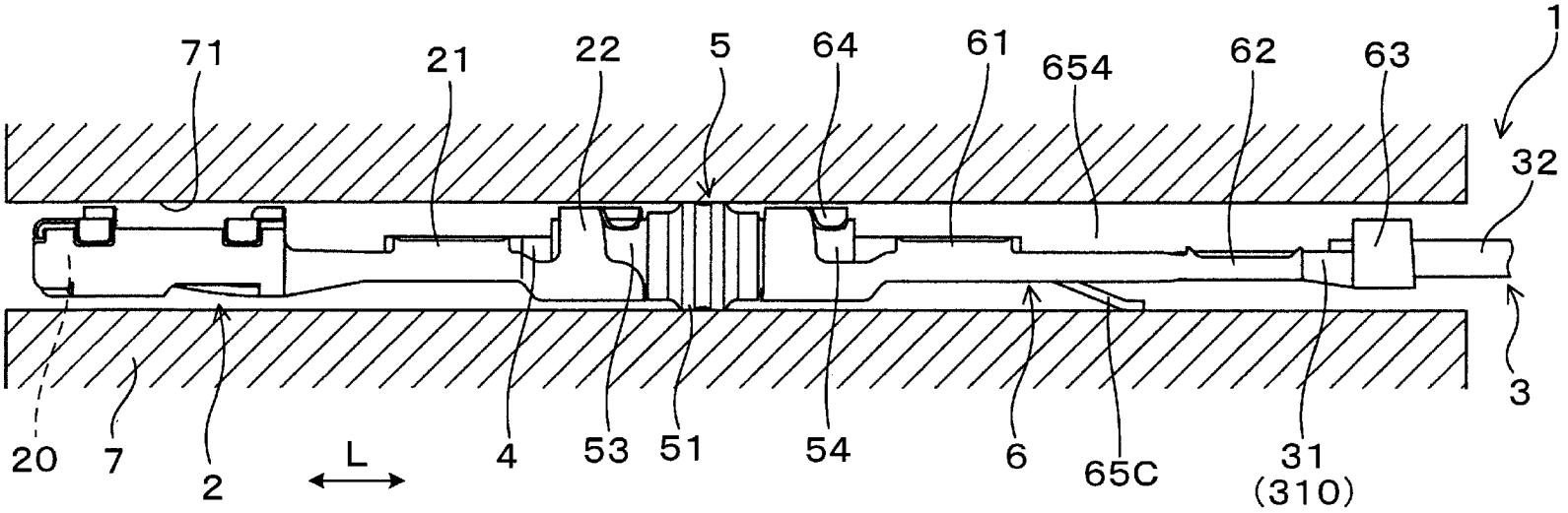
FIG. 14 is a plan view showing another terminal-equipped wire according to the fourth embodiment inserted in the insertion hole of the connector case.
Figure 15:
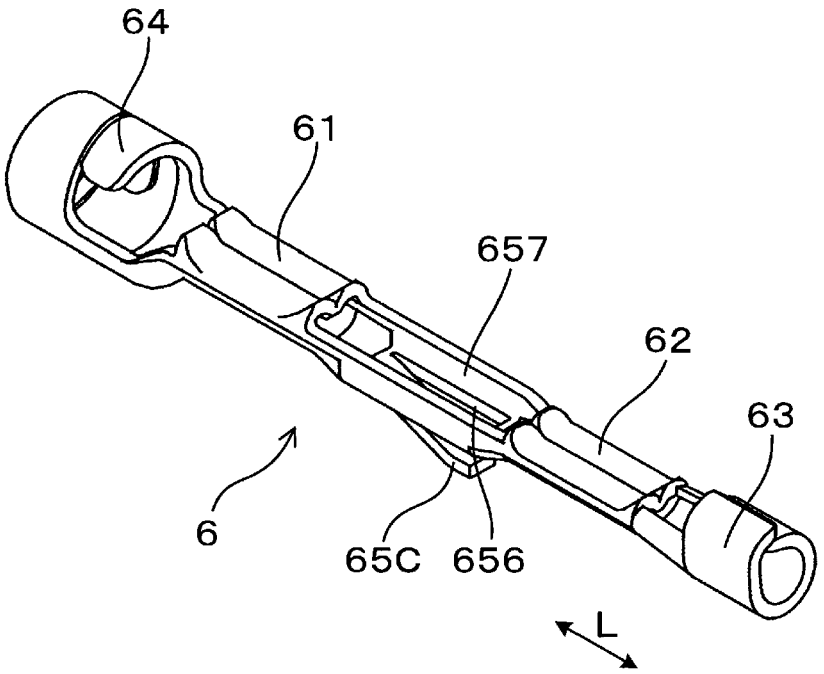
FIG. 15 is a perspective view showing the other terminal-equipped wire according to the fourth embodiment.

Further, as shown in FIGS. 14 and 15, a projection 65C can be formed as a cantilever beam having one end in the longitudinal direction L supported on the body of the connection terminal 6 by cutting a part of the connection terminal 6 by a slit (cutout) 656 in an intermediate part of the connection terminal 6 in the longitudinal direction L. In this case, conductive portions 657 constituting the body of the connection terminal 6 are formed on both sides of the projection 65C in a direction perpendicular to the longitudinal direction L.

Also in this case, the projection 65C is resiliently deformable and can come into contact with the insertion hole 71 by generating a spring force. Further, the projection 65C projects obliquely from the body of the connection terminal 6 from a tip (side of the connector terminal 2) toward a base end (side of the wire 3) in the longitudinal direction L to facilitate the insertion of the terminal part of the terminal-equipped wire 1 into the insertion hole 71.

Note that the projections 65, 65A, 65B and 65C may be hardly resiliently deformed rather than being resiliently deformable. In this case, a slight clearance is formed between the projections 65 and the insertion hole 71 when the terminal part of the terminal-equipped wire 1 is inserted into the insertion hole 71. In other words, the projections may not have spring characteristics without being limited to projections resiliently deformable and having spring characteristics.

The projections 65, 65A, 65B, 65C of this embodiment may be provided in the connection terminals 6 shown in the second and third embodiments. The other configuration, functions, effects and the like of the terminal-equipped wire 1 of this embodiment are the same as in the second embodiment. Further, constituent elements denoted by the same reference signs as those of the second embodiment are the same as those of the second embodiment.

Fifth Embodiment

A terminal-equipped wire 1 different from that of the second embodiment in the structures of a relay conductor 4 and a sealing member 5 is shown in this embodiment.

Figure 16:
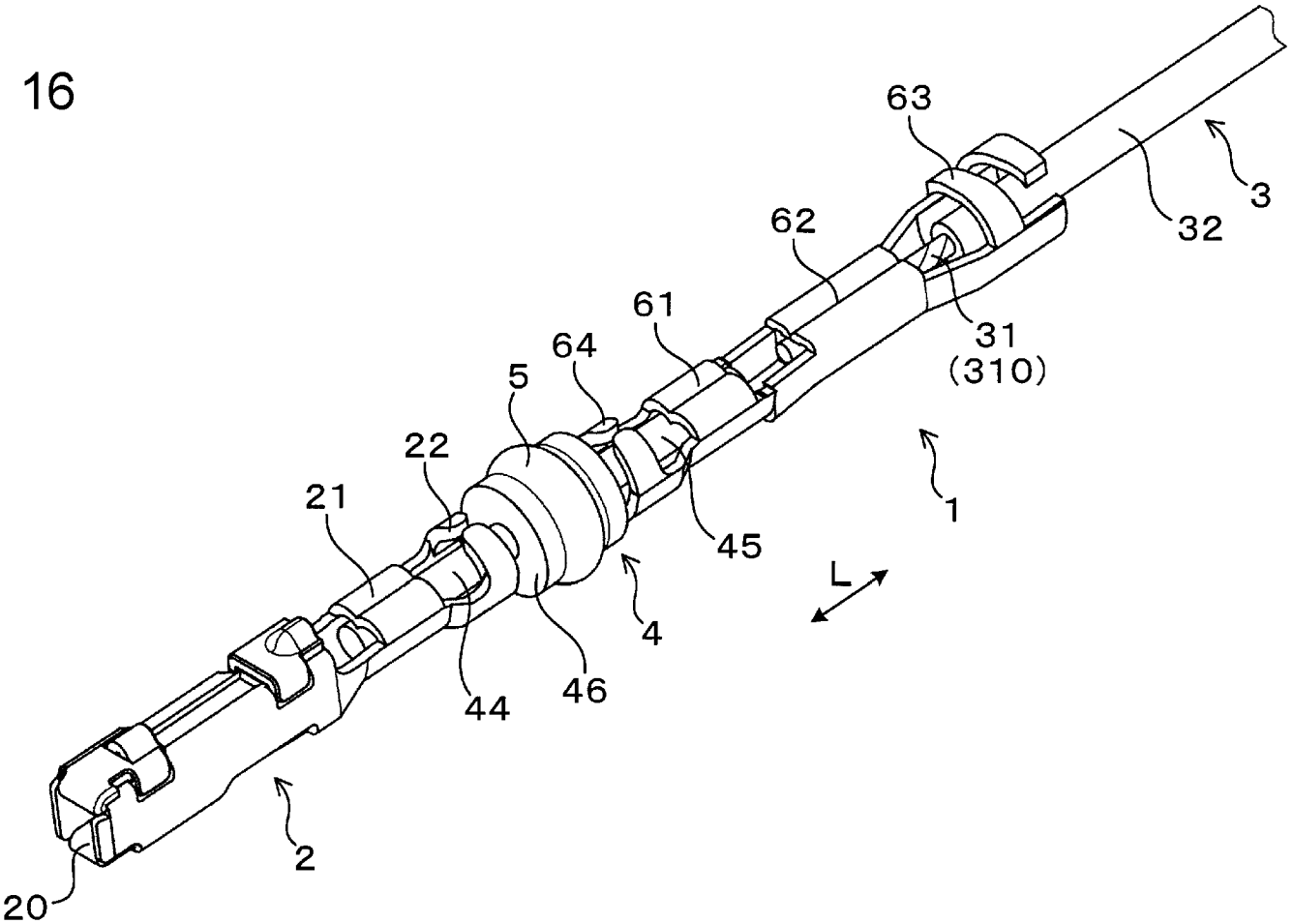
FIG. 16 is a perspective view showing a terminal-equipped wire according to a fifth embodiment.
Figure 17:
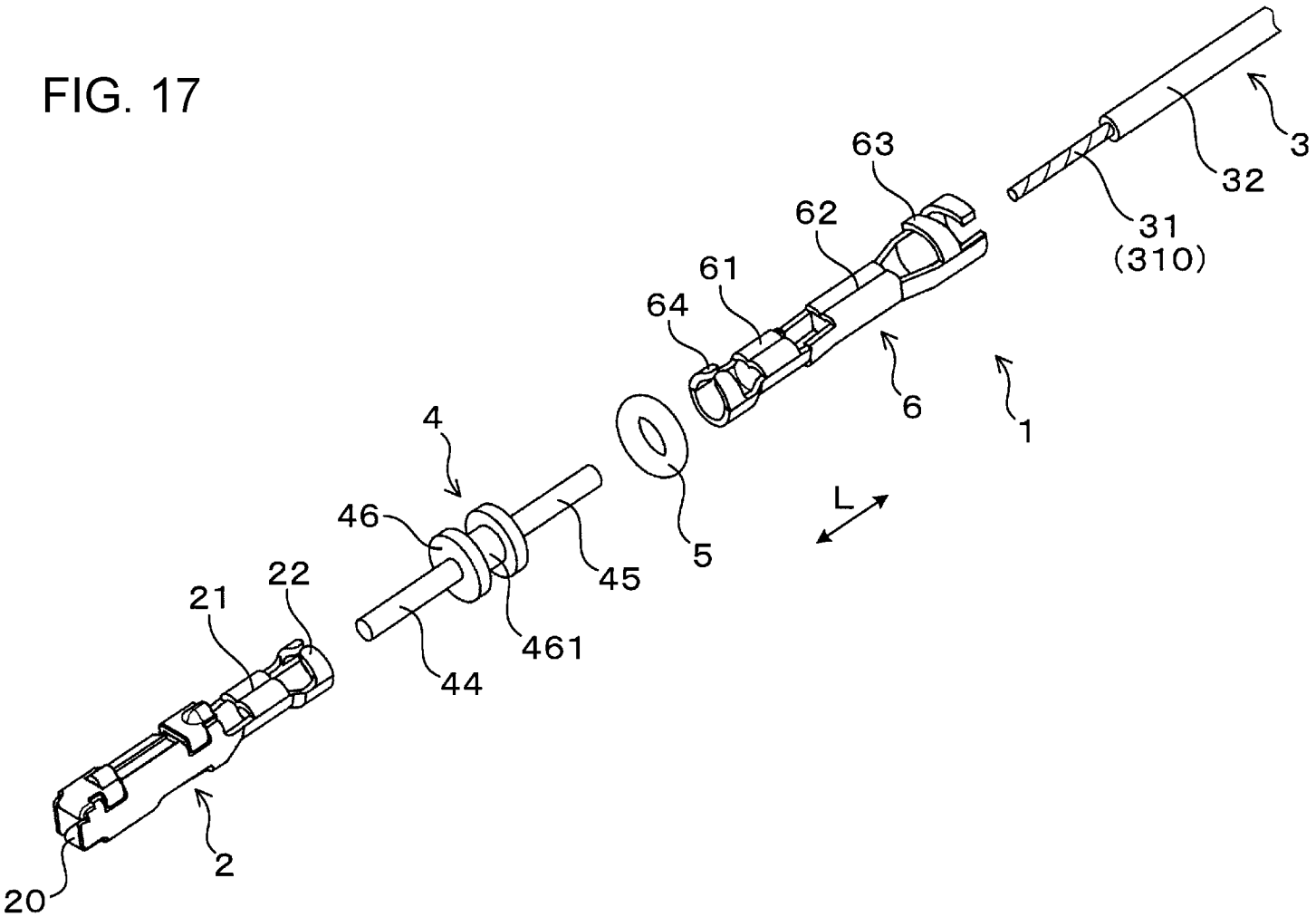
FIG. 17 is a perspective view showing each component of the terminal-equipped wire according to the firth embodiment.

As shown in FIGS. 16 and 17, a part where the sealing member 5 is to be mounted is formed to have a larger diameter than other parts in the relay conductor 4 of this embodiment. The sealing member 5 is constituted by an O-ring made of rubber and having an annular shape and a circular cross-section. The relay conductor 4 includes a first shaft 44 to be connected to a second terminal connecting portion 22 provided in a connector terminal 2, a second shaft 45 to be connected to a fourth connecting portion 64 provided in a connection terminal 6 and a diameter enlarged portion 46 having a larger diameter than the first and second shafts 44, 45. The first shaft 44, the second shaft 45 and the diameter enlarged portion 46 have circular cross-sections.

A groove 461 is formed in an intermediate part of the diameter enlarged portion 46 in a longitudinal direction L and can receive the O-ring. The O-ring is positioned in an axial direction of the relay conductor 4 by being arranged in the groove 461. A first terminal connecting portion 21 and a second terminal connecting portion 22 of the connector terminal 2 are crimped to the first shaft 44 of the relay conductor 4. A first connecting portion 61 and the fourth connecting portion 64 of the connection terminal 6 are crimped to the second shaft 45 of the relay conductor 4.

The terminal-equipped wire 1 can be manufactured as in the case of the second embodiment. The O-ring is a standard product and can be used as the sealing member 5 to reduce the manufacturing costs. Further, use of the O-ring enables a length of the relay conductor 4 to be made shorter as compared to the second to fourth embodiments.

The other configuration, functions, effects and the like of the terminal-equipped wire 1 of this embodiment are the same as in the second embodiment. Further, constituent elements denoted by the same reference signs as those of the second embodiment are the same as those of the second embodiment.

The invention is not limited only to the respective embodiments and further different embodiments can be configured without departing from the gist of the present invention. Further, the invention includes various modifications, modification within the scope of equivalents and the like.

The invention claimed is:

1. A terminal-equipped wire, comprising:

a connector terminal to be arranged in an insertion hole provided in a connector case;

a wire formed by bundling a plurality of conductors;

a conductive relay conductor having a first shaft to be connected to a terminal connecting portion, a second shaft extending opposite the first shaft, and a diameter enlarged portion having a larger diameter than the first and second shafts;

a connection terminal having a first connecting portion connected to the second shaft of the relay conductor and a second connecting portion connected to the wire; and a sealing member in the form of an O-ring mounted on an outer periphery of the diameter enlarged portion, the sealing member being arranged in the insertion hole to close a clearance between the sealing member and the relay conductor and a clearance between the sealing member and the insertion hole.

2. The terminal equipped wire of claim 1, wherein the sealing member includes:

a connecting outer peripheral portion to be connected to at least one of a terminal connecting portion provided in the connector terminal and a connecting portion provided in the connection terminal; and a sealing portion for closing the insertion hole.

3. The terminal-equipped wire of claim 2, wherein the connecting outer peripheral portion is composed of a first connecting outer peripheral portion to be connected to the terminal connecting portion and a second connecting outer peripheral portion to be connected to the connecting portion.

4. The terminal equipped wire of claim 3, wherein the connection terminal is formed with a projection for coming into contact with the insertion hole.

* * * * *